US005943525A

United States Patent [19]

Endo et al.

[11] Patent Number: 5,943,525

[45] Date of Patent: Aug. 24, 1999

[54] TONER REMAINING DETECTION UNIT IN AN IMAGE FORMING APPARATUS

[75] Inventors: Yoshinori Endo, Toyota; Hiroshi Nakano, Nagoya, both of Japan

[73] Assignee: Brother Kogyo Kabushiki Kaisha, Nagoya, Japan

[21] Appl. No.: 09/026,168

[22] Filed: Feb. 19, 1998

[30] Foreign Application Priority Data

Feb. 28, 1997 [JP] Japan ..... 9-062084
Mar. 31, 1997 [JP] Japan ..... 9-080235

[51] Int. Cl.[6] ..... G03G 15/08

[52] U.S. Cl. ..... 399/27; 399/61; 399/262

[58] Field of Search ..... 399/27, 61, 224, 399/258–259, 262, 28

[56] References Cited

U.S. PATENT DOCUMENTS

| | | | |
|---|---|---|---|
| 4,506,804 | 3/1985 | Oka . | |
| 5,035,198 | 7/1991 | Niito | 399/27 |
| 5,237,372 | 8/1993 | Ishii et al. | 399/59 |
| 5,499,077 | 3/1996 | Endo et al. . | |
| 5,512,980 | 4/1996 | Yamaguchi et al. | 399/61 X |
| 5,532,790 | 7/1996 | Akazawa . | |
| 5,532,791 | 7/1996 | Takahashi et al. | 399/61 X |
| 5,557,368 | 9/1996 | Endo et al. . | |
| 5,758,224 | 5/1998 | Binder et al. | 399/27 X |
| 5,790,917 | 8/1998 | Takura et al. | 399/27 |

FOREIGN PATENT DOCUMENTS

| | | |
|---|---|---|
| 59-126570 | 7/1984 | Japan . |
| 63-002087 | 1/1988 | Japan . |
| 3-091852 | 4/1991 | Japan . |
| 5-88550 | 4/1993 | Japan . |
| 6-138768 | 5/1994 | Japan . |
| 7-306595 | 11/1995 | Japan . |
| 8-211671 | 8/1996 | Japan . |
| 1-55105 | 2/1998 | Japan . |

*Primary Examiner*—Arthur T. Grimley
*Assistant Examiner*—Quana Grainger
*Attorney, Agent, or Firm*—Oliff & Berridge, PLC

[57] ABSTRACT

A toner remaining detection unit is provided that displays the amount of remaining toner according to the number of transitions from a low state to a full state. This operation ensures that the amount of remaining toner is not determined incorrectly when toner fluidity is reduced, while change of remaining state display is minimized when toner fluidity is good. If toner is not being stirred, initialization at toner replacement is performed. If the toner is being stirred, toner display control processing is performed. If neither an empty nor a low state is detected and a counter value does not reach 15, low display is turned off. If the previous state was a low state, 1 is added to the count value. When a low state is detected, or when a low state is not detected but the counter value reaches 15, the low display is turned on.

20 Claims, 7 Drawing Sheets

TONER REMAINING DETECTION UNIT IN AN IMAGE FORMING APPARATUS

BACKGROUND OF THE INVENTION

1. Field of Invention

This invention relates to an image forming apparatus for forming images by the electrophotography method by using electrically charged toner. In particular, this invention relates to a unit for detecting the amount of remaining toner within a toner cartridge.

2. Description of Related Art

Most of conventional image forming apparatuses have a detachable toner cartridge for accommodating toner used for development, so that the toner cartridge must be unloaded to replace toner the remaining amount of which has become low after use for a certain period of time. Therefore, in order that users can determine a toner replacement time, a toner remaining detection unit is often provided to display the amount of remaining toner. Such a display method is not required to display an accurate amount of remaining toner. Generally, users are fully satisfied if they can determine whether the toner is in a full state in which a sufficient amount of toner remains, it is empty to such an extent that it must be replaced, or it is in low state in which it must be replaced in near future.

As a toner remaining detection unit of this sort, for example, there is known a method by which the time is measured from when toner is removed from a slot provided in a lower portion of a toner cartridge and to when it fills the slot again in such a way to periodically sweep the slot using a wiper and detecting the existence of light passage through the slot. Since the time is short when a large amount of toner remains, the amount of remaining toner can be detected by comparison with a predetermined reference time.

If a small number of levels, such as the three levels described above, is provided to detect the amount of remaining toner, the detected state is not stationary but variable during transition among the detection levels. For example, once a transition has been made to a low state or an empty state, it is normal to perform control so as not to return the indication of the remaining amount to a previous state.

However, in the above mentioned toner remaining detection method, there is a problem when toner fluidity becomes bad immediately after power on, toner replacement, or the like. That is, in the above mentioned example, when the slot is swept by a wiper, if toner fluidity is low, it takes a long time for toner to fill the slot again, and an incorrect state may be displayed. One example is that the low state is displayed after toner replacement although the toner remains full. In this case, when toner fluidity increases in the course of toner use, a full state indication is obtained. However, as described above, since the existing display state is not returned to the previous display state, it is difficult to correctly display the amount of remaining toner.

To avoid such an incorrect determination, for example, when the result of determining the amount of remaining toner changes from the low state to the full state, since the result of determining the amount of remaining toner depends on the change in toner fluidity, the empty state display may suddenly appear before the low state is displayed for a sufficient period of time. This poses a problem to users in terms of operability.

SUMMARY OF THE INVENTION

The invention has been made to solve the above-mentioned problem. It is an object of the invention to provide a toner remaining detection unit in an image forming apparatus which permits the amount of remaining toner to be correctly detected regardless of the change in toner fluidity.

To solve the above-mentioned problem, the toner remaining detection unit includes a toner cartridge for accommodating toner to be supplied to a developing chamber; a toner remaining detection unit for detecting the amount of remaining toner within the toner cartridge; a remaining state determination unit, in accordance with the amount of remaining toner detected by the toner remaining detection unit, for determining whether the toner is in a full, empty, or low state; a display control unit for determining display contents from a remaining state determined by the display control unit; and a display unit for displaying display contents determined by the display control unit, wherein the display control unit displays a determination result of the remaining state determination unit without modification, but performs control so as not to return the display contents from a full state to a low state after the number of times a determination result of the remaining state determination unit has changed from a low state to a full state has reached a predetermined number, and low state occurs after power on or replacement of the toner cartridge.

According to the toner remaining detection unit of the invention, the situation described below can be improved. That is, when a toner cartridge has been stored for a long time, such as at power on or toner replacement, the fluidity of toner within the toner cartridge is bad. If the amount of remaining toner is detected in such a state, a low state may be displayed even when a large amount of toner remains. However, this occurs at an initial stage of the counting of the number of transitions from a low state to a full state, which does not yet reach a predetermined setting value. Accordingly, the transition of the state display is free, so that it cannot be concluded that the low state is incorrectly displayed when a large amount of toner remains, because the return to the full state from a temporary transition to a low state is possible. On the other hand, when toner fluidity becomes good in the course of use, although the transition from the low state to the full state occurs initially, if the count value exceeds a predetermined value, the above transition does not occur, so that transient changes of the remaining state display can be avoided and the low state can be displayed for a sufficient period of time before the transition to the empty state, providing improved operability.

The toner cartridge is detachable and has a depression formed at a lower portion thereof and a slot for storing toner being formed in the depression. The toner remaining detection unit includes a wiper for periodically sweeping the slot, toner existence detection unit for detecting the existence of toner within the slot, and a unit for determining a remaining amount of the toner based on time-based change of existence of toner within the slot.

The toner remaining detection unit includes a detachable cartridge that includes a wiper that periodically sweeps a slot provided at a lower portion thereof and determines the amount of remaining toner from the time-based change of existence of the toner in the slot. This toner remaining detection unit minimizes an incorrect determination when toner fluidity is reduced, prevents a quick change of the remaining state display when toner fluidity is good, thus providing improved operability.

The toner remaining detection unit further includes a toner existence detection unit including a toner sensor having a light source section and a light receiving section which are placed at a lower portion of the toner cartridge. An optical axis is formed between the light source section and the light receiving section so as to pass light through the slot.

The toner remaining detection unit permits the amount of remaining toner to be correctly detected with high operability regardless of the degree of toner fluidity when a light sensor is used along with the wiper and slot.

The toner remaining detection unit further includes a stirrer that is subjected to rotational control to stir toner that is provided within the toner cartridge. A wiper is provided as part of the stirrer.

The toner remaining detection unit is structured so that the wiper is attached to the stirrer within the toner cartridge so as to be rotatable with the stirrer and permits the amount of remaining toner to be correctly detected with high operability regardless of the degree of toner fluidity.

BRIEF DESCRIPTION OF THE DRAWINGS

The preferred embodiment of the invention will be described in detail with reference to the following figures wherein.

DETAILED DESCRIPTION OF PREFERRED EMBODIMENTS

The preferred embodiment of the invention will be described in conjunction with the attached drawings. This embodiment described below relates to application of the invention to laser printers. However, the invention may be applied to any other apparatus that employs toner cartridges for printing.

(I) Overall construction and operation

Figure 1:
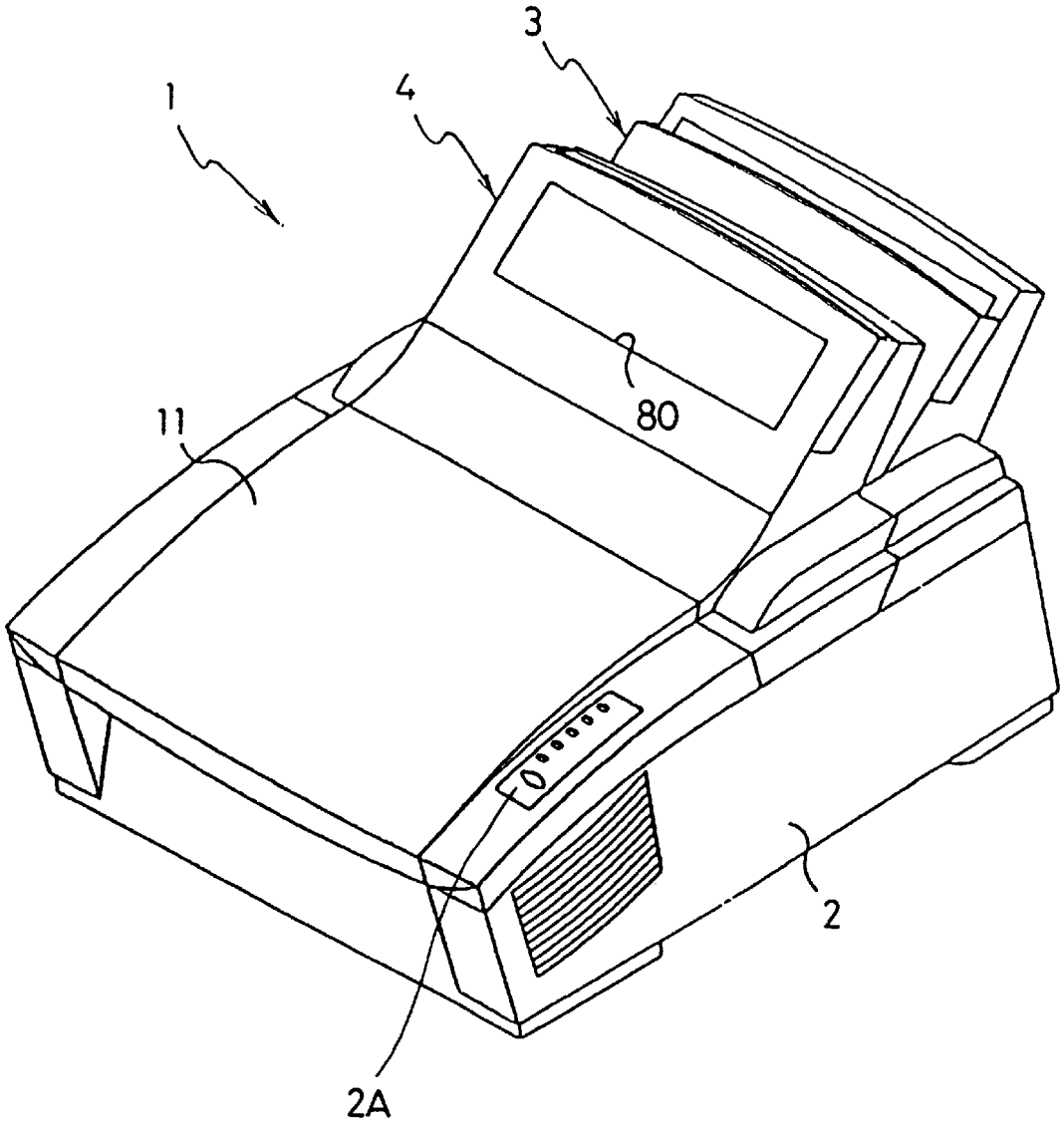
FIG. 1 is a perspective view showing the appearance of a laser printer.

First, the overall construction of the laser printer associated with this embodiment will be described with reference to FIGS. 1 and 2. FIG. 1 is a perspective view of a laser printer according to this embodiment and FIG. 2 is a longitudinal sectional view of a central portion thereof.

Figure 2:
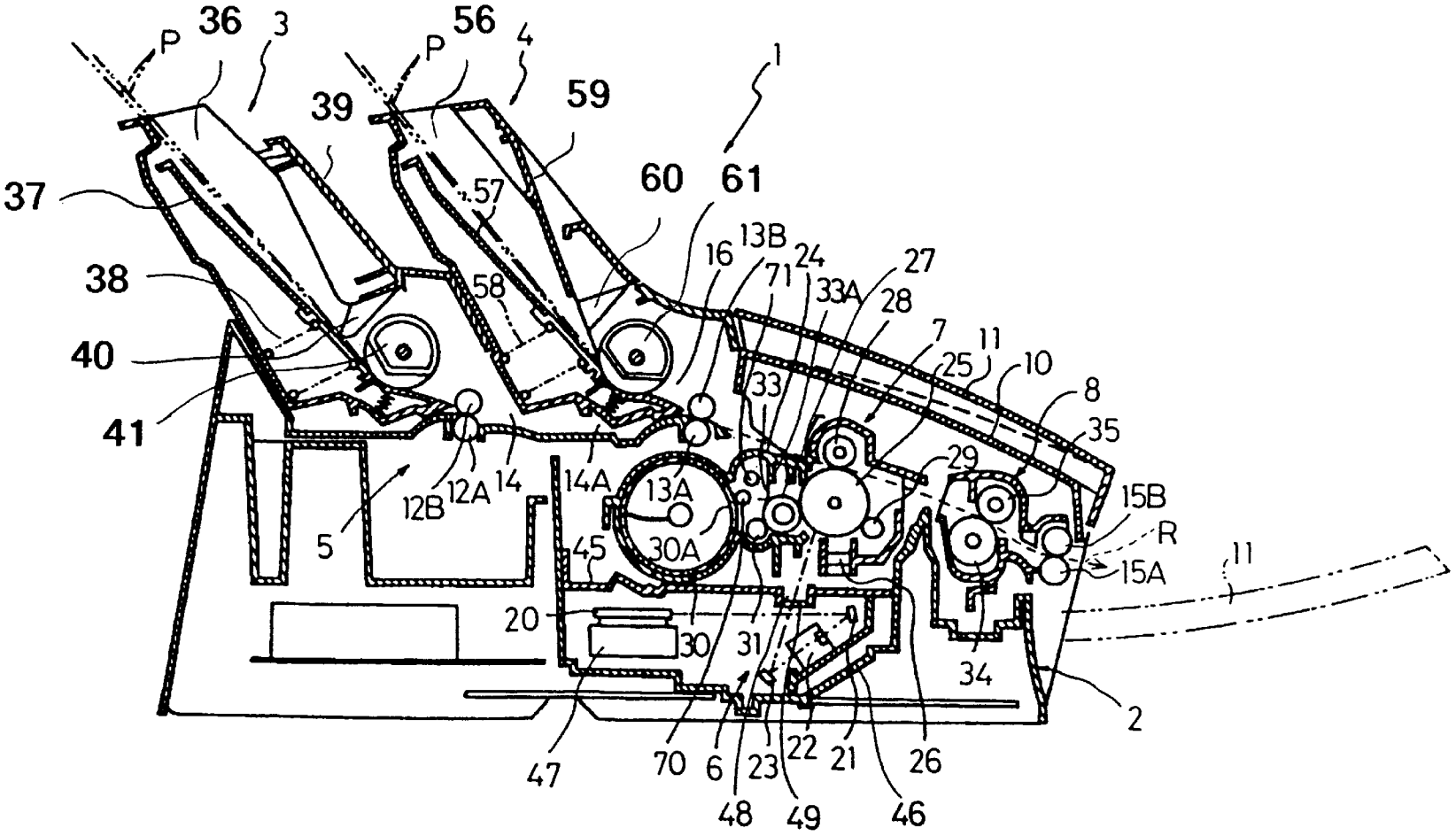
FIG. 2 is a sectional side elevation view in a laser printer.

As shown in FIGS. 1 and 2, a laser printer 1 of this embodiment comprises: a body case 2; a first sheet supply tray unit 3 and a second sheet supply tray unit 4 provided on the backward upper face of the body case 2; a sheet feeding mechanism 5 provided within the body case 2; a scanner unit 6; a process unit 7; a fixing unit 8; and a driving unit (not shown) housed at the left side in the front of the body case 2 for driving the first sheet supply tray unit 3, second sheet supply tray unit 4, sheet feeding mechanism 5, and the process unit 7 as a developing device, the fixing unit 8, and the like.

On the front upper section of the body case 2 are provided a top cover 10 capable of opening the inside of the laser printer 1 and a sheet ejection tray 11. The sheet ejection tray 11 can be switched freely from the closed position indicated as a bold line in FIG. 2 to the opened position indicated by a dashed line. In the closed position, the sheet ejection tray functions as a tray which receives and stacks recorded sheets.

Of the above-mentioned structure, the scanner unit 6, process unit 7, and fixing unit 8 make up a print mechanism section for actual recording. The process unit 7 houses a photosensitive drum 25, a charger 26, a developing roller 27, a transfer roller 28, a cleaning roller 29, and the like within a casing 24. This structure permits a cartridge to be loaded in or unloaded from a predetermined location within the body case 2.

Moreover, the first sheet supply tray unit 3 is fixed on the upper face near the back of the body case 2 and the detachable second sheet supply tray unit 4 is provided on the upper face in front of the first sheet supply tray unit 3.

On the other hand, the sheet feeding mechanism 5, which selectively feeds a sheet from the first sheet supply tray unit 3 or second sheet supply tray unit 4 to the process unit 7, comprises a pair of feed rollers 12A and 12B provided in the lower end of the first sheet supply tray unit 3 and registration rollers 13A and 13B provided in the front of the lower end of the second sheet supply tray unit 4. Of these rollers, the feed roller 12A is a driving roller and the feed roller 12B is a slave roller. The registration roller 13A is a driving roller and the registration roller 13B is a slave roller.

A sheet transporting route 14 from the first sheet supply tray unit 3 to the registration rollers 13A and 13B includes a lower transporting route 14A extending along the lower face of the second sheet supply tray unit 4. When the second sheet supply tray unit 4 is removed from the body case 2, the lower transporting route 14A is opened outward.

Moreover, a sheet supplied from the first sheet supply tray unit 3 is fed by the feed rollers 12A and 12B, arrives in the registration rollers 13A and 13B via the lower transporting route 14A, and is transported to the process unit 7 after registration.

On the other hand, a sheet supplied from the second sheet supply tray unit 4 arrives in the feed rollers 13A and 13B and is transported to the process unit 7 after registration.

Next, the first sheet supply tray unit 3 will be described in detail. The first sheet supply tray unit 3 comprises: a tray case 36 capable of accommodating a plurality of sheets P on a backward rising slope; a sheet receipt plate 37 for receiving the bottom of sheets P provided at the bottom of the tray case 36; a compression coil spring 38 for pressing the sheet receipt plate 37 forward; a tray cover 39 opposite to the front of the sheet receipt plate 37 that is capable of being opened to a predetermined angle and rotatably mounted in the vicinity of the bottom of the tray case 36; a release mechanism 40 that has an interlocking relationship with the opening operation of the tray cover 39 so that the sheet receipt plate 37 is released from the force of the compression coil spring 38; and a sheet supply roller 41.

Moreover, the second sheet supply tray unit 4 comprises: a tray case 56 capable of accommodating a plurality of sheets P on a backward rising slope; a sheet receipt plate 57 for receiving the bottom of sheets P that is provided at the bottom of the tray case 56; a compression coil spring 58 for pressing the sheet receipt plate 57 forward; a tray cover 59 opposite to the front of the sheet receipt plate 57 that is capable of being opened to a predetermined angle and rotatably mounted in the vicinity of the bottom of the tray case 56; a release mechanism 60 that has an interlocking relationship with the opening operation of the tray cover 59 so that the sheet receipt plate 57 is released from the force of the compression coil spring 58; and a sheet supply roller 61. A manual sheet supply port 80 for manually supplying sheets P is provided in the front of the second sheet supply unit 4.

Next, the process unit 7 will be described in detail in reference to FIGS. 2 and 3. The process unit 7 supplies toner to an electrostatic latent image formed on the surface of the photosensitive drum 25 in accordance with image data to be recorded by a laser optical system (described below) provided in the scanner unit 6, thereby developing the latent image.

That is, the process unit 7 comprises: the photosensitive drum 25, the transfer roller 28 contacting the top thereof, the scorotron-type charger 26 placed below the photosensitive drum 25, the developing device comprising the developing roller 27 and a toner supply roller 31 which are placed upstream in the sheet supply path with respect to the photosensitive drum 25, a detachable toner cartridge 30 placed further upstream; and a cleaning roller 29 placed downstream in the sheet supply path with respect to the photosensitive drum 25.

In the developing chamber of the developing device (referring to a section comprising the toner supply roller 31, the developing roller 27, an upper auger 71 and a lower auger 70, described below), the lower auger 70 and upper auger 71 are rotatably placed above the toner supply roller 31. The lower auger 70 transports toner supplied to the developing chamber from the toner cartridge 30 to both ends of the toner supply roller 31 above it via a toner supply port 30A. The toner supply port 30A comprises an opening formed at the near-center of the toner cartridge 30 and an opening formed in the casing 24. The upper auger 71 transports toner from both ends of the toner supply roller 31 to the toner supply port 30A. The toner thus supplied to the developing chamber from the toner supply port 30A is circularly transported in both directions towards the ends of the toner supply roller 31 below it. While being circularly transported, the toner is supplied and deposited on the toner supply roller 31. Moreover, in this embodiment, between the above mentioned upper auger 71 and the lower auger 70 is placed an auger diaphragm 72 parallel to the rotation axis of the respective augers, for promoting a toner transportation function in conjunction with the upper and lower augers.

A sensor wiper 92A attached to a stirrer 92 within the toner cartridge 30, and a toner sensor 90 placed in a lower portion of the toner cartridge 30, together detect the amount of remaining toner within the toner cartridge 30. Detailed unit construction and functions on detection of the amount of remaining toner will be described below.

A blade 33 is secured to the lower face of the casing 24 above the developing roller 27 by means of an L-type blade securing member 33A. The blade 33 charges the toner supplied from the toner supply roller 31 to the developing roller 27 to a predetermined polarity, as well as limits the thickness of toner layer to a predetermined thickness.

Moreover, on the outer circumference of the photosensitive drum 25 is formed an electrostatic latent image corresponding to image data to be recorded in such a way that the scanner unit 6 emits laser beams to a charged layer formed in the charger 26 while scanning the image. At this time, after the toner within the toner cartridge 30 is stirred by the stirrer 92 and discharged from the toner supply port 30A, the toner is supported on the outer circumference of the developing roller 27 by way of the toner supply roller 31 and limited in the thickness by the blade 33. In this way, the toner is deposited by the developing roller 27 onto the electrostatic latent image formed on the photosensitive drum 25, to develop a visible image which is transferred to a sheet P passing between the transfer roller 28 and the photosensitive drum 25.

After the image is transferred to the sheet P, the remaining toner left on the photosensitive drum 25 is electrically held on the cleaning roller 29 for a temporary period. The toner is electrically returned to the photosensitive drum 25 at a predetermined time, such as the time between the sheet P and the next sheet P. The toner is then supported by the developing roller 27 and withdrawn to the developing chamber.

Next, the scanner unit 6 will be described. As shown in FIG. 2, the scanner unit 6, which includes a known laser optical system, scans based on inputted image data to be recorded and forms an electrostatic latent image on the surface of the photosensitive drum 25.

To be more specific, the scanner unit 6 is placed below the process unit 7 and a scanner cover 45 is mounted on the upper face of the scanner unit 6. The scanner cover 45 is secured in a way that covers most of the opening section of the bottom plate 46 upstream in the sheet supply path in the body case 2. The scanner unit 6 comprises a laser emission section (not shown), such as a semiconductor laser, a scanner motor 47, a polygon mirror 20, a lens 22, reflecting mirrors 21 and 23, and the like, which are placed on the lower face of the scanner cover 45. A laser light is emitted to the outer circumference of the photosensitive drum 25 after passing through a glass plate that is embedded in a laterally long scanner opening 48 formed in the scanner cover 45 to extend along the rotation axis line of the photosensitive drum 25. This forms an electrostatic latent image on the outer circumference on the photosensitive drum 25 in accordance with image data. Toner is supplied through the process unit 7 to an electrostatic latent image formed on the photosensitive drum 25 by the laser optical system of the scanner unit 6, so that the electrostatic latent image is developed by the toner.

Next, a toner image corresponding to the electrostatic latent image formed on the photosensitive drum 25 within the process unit 7 is transferred to the sheet P. Sheet P is transported to the process unit 7 and then to the fixing unit 8. The fixing unit 8, which thermally fixes the toner transferred to the sheet P, comprises: a heating roller 34; a pressing roller 35 pressing against said heating roller 34; a pair of ejection rollers 15A and 15B provided downstream with respect to the heating roller 34, and the pressing roller 35 to eject the sheet P out of the body case 2.

In FIG. 2, a route R of the sheet P from the registration rollers 13A and 13B to the sheet ejection tray 11 placed downstream in the sheet supply path is shown as a dashed line.

(II) Construction and function of the toner remaining detection unit

Next, the construction of the process unit 3 in the vicinity of the toner cartridge 30 will be described with reference to FIGS. 3 and 4. FIG. 3 is a sectional side elevation view of the process unit 7 and FIG. 4 is a horizontal sectional view of the toner cartridge 30. A detachable toner cartridge 30 of double cylindrical shape accommodates toner to be supplied to the developing chamber. In the toner cartridge 30, a rotatable stirrer 92 is provided for stirring the toner. The stirrer 92 is structured so that the rotation axis 92C is supported in parallel longitudinally with respect to toner cartridge 30 and blades 92D, so that the toner within the toner cartridge 30 can be sufficiently stirred by rotation of the rotation axis 92C (FIG. 4). The Blades 92D are formed integrally with a blade 92B comprising a PET film at the center. The blade 92B plays a major role of feeding toner within the cartridge 30 from the toner supply port 30A to the developing chamber. The pair of blades 92D at both sides of the blade 92B collect the toner in the vicinity of both ends of the cartridge 30 and push the toner toward the center. At the center of the stirrer 92, the sensor wiper 92A, placed in the direction opposite to the blade 92B, is formed integrally with the blade 92B and rotates within the toner cartridge 30 jointly with the stirrer 92 by rotation along the rotation axis 92C (FIG. 4).

On the other hand, a depression 93 is formed at the center of the cabinet 30B of the toner cartridge 30, a slot 94 is provided at the center of the depression 93, and toner within the slot 94 is wiped off by rotation of the sensor wiper 92A (FIG. 4).

Figure 3:
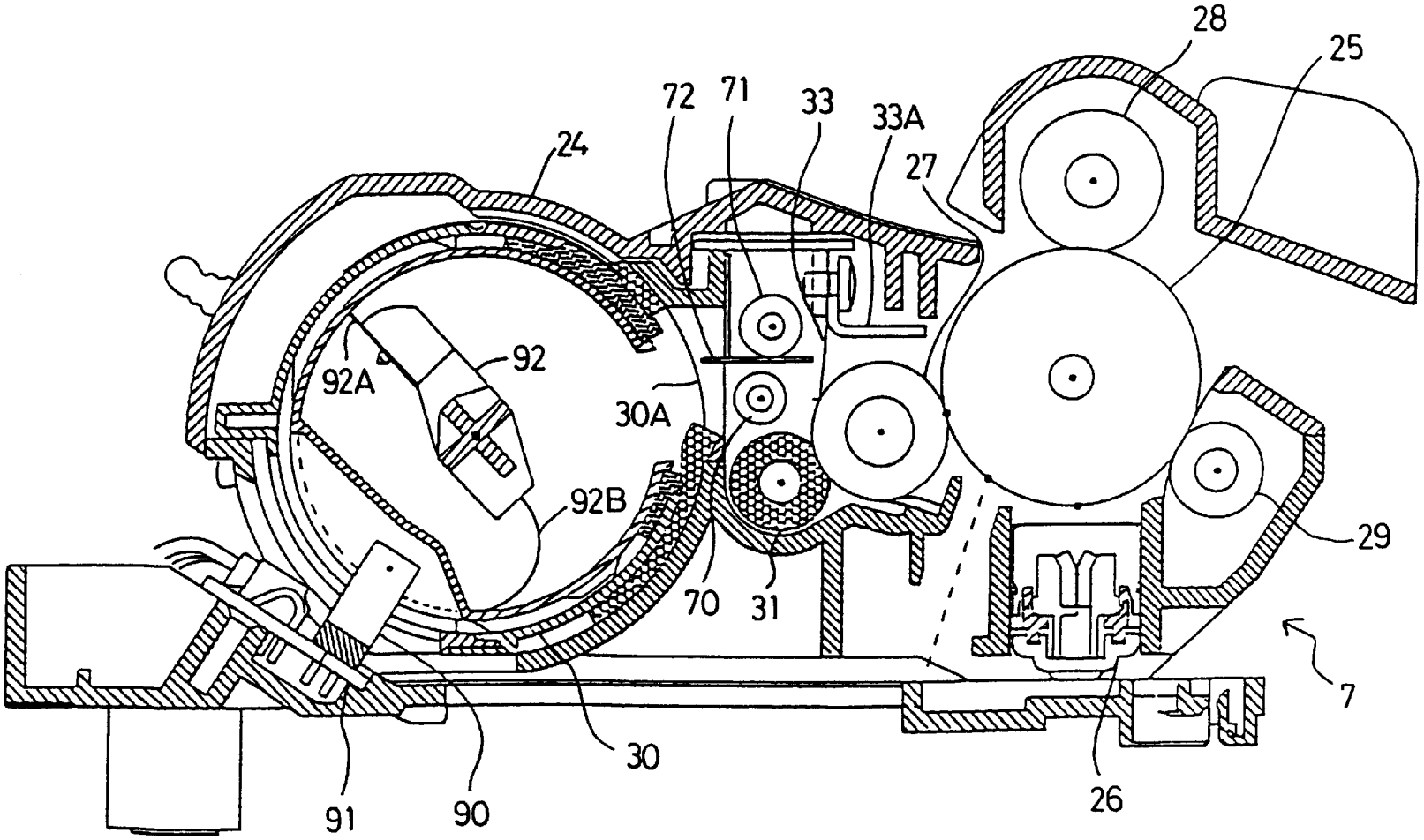
FIG. 3 is a sectional side elevation view in a process unit.
Figure 4:
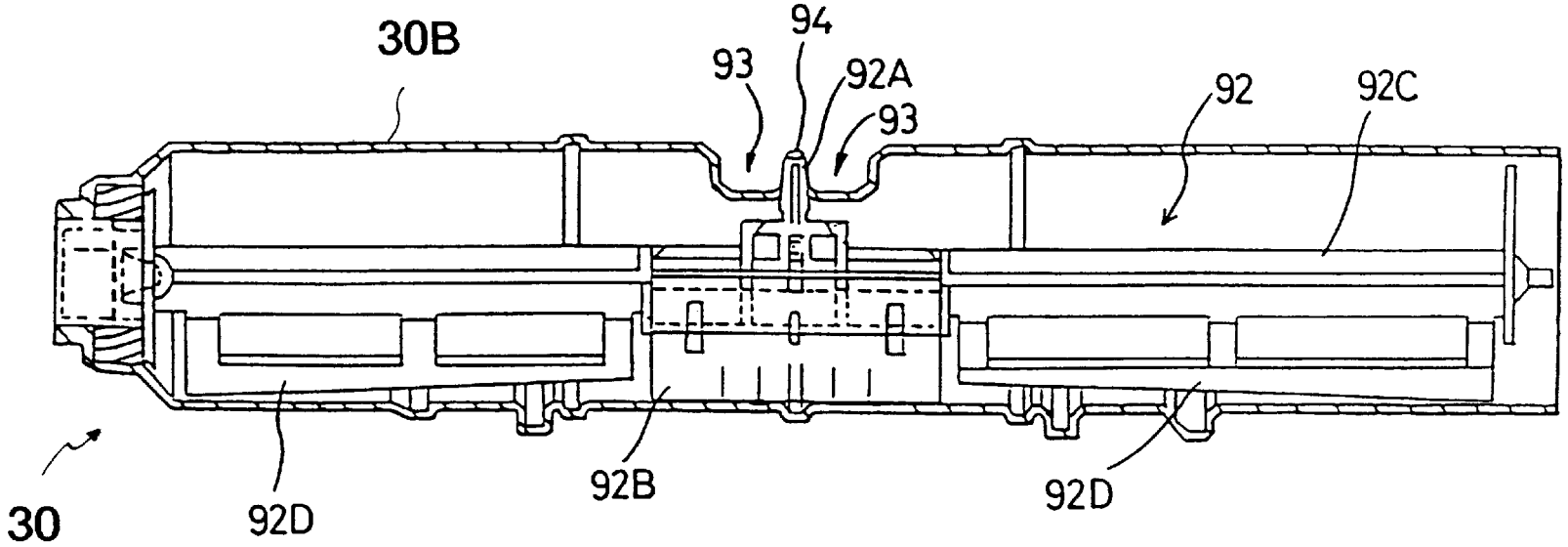
FIG. 4 is a horizontal sectional view of a toner cartridge.

In a lower portion of the toner cartridge 30, the toner sensor 90 includes a light source section and light receiving section and is secured in a slanting direction on a ramp 91 (FIG. 3). The light source section and the light receiving section are provided in an arrangement that fits in the depression 93 provided in the cabinet 30B of the toner cartridge 30, and is placed so that an optical axis therebetween passes through the slot 94.

Accordingly, when a sufficient amount of toner exists in the toner cartridge 30, before toner within the slot 94 is wiped off by the sensor wiper 92A, the toner blocks the light axis of the toner sensor 90, so the light receiving section detects no light. On the other hand, if toner within the slot 94 is wiped off by the sensor wiper 92A by rotation of the stirrer 92, the light axis of the toner sensor 90 is not blocked and the light receiving section detects light. Accordingly, the existence of toner within the slot 94 can be detected by the toner sensor 90.

Although toner within the slot 94 becomes temporarily empty because of passage of the sensor wiper 92A, since the surrounding toner flows in across the depression 93 or toner being stirred drops from the blade 92B of the stirrer 92, the slot 94 is filled with toner. Normally, the more toner within the toner cartridge 30, the shorter the time from when the sensor wiper 92A passes through to when the slot 94 is filled with toner again, that is, the length of time during which the toner sensor 90 is detecting light. Accordingly, by monitoring the time length at all times, the amount of remaining toner within the toner cartridge 30 can be determined. Since the sensor wiper 92A rotates jointly with the stirrer 92, by determining the time length in step with the rotation cycle of the stirrer 92, the amount of remaining toner can be detected according to changes in the amount of remaining toner being stirred.

In this embodiment, the amount of remaining toner is detected at three levels: full, low, and empty. The term full means a normal state in which a sufficient amount of toner remains, the term empty denotes an semi-shortage state in which the amount of toner is in such a low quantity that it must be replaced, and the term low indicates a shortage state in which more toner remains than in the empty state but the amount of the remaining toner is not sufficient. The three levels of detection state are displayed in the display section 2A on the upper surface of the body case 2 in FIG. 1. The full display tells the user that a sufficient amount of toner remains, and the empty display prompts the user to replace the toner. The low display warns the user that an empty state is near.

A desirable method for determining the three levels of toner is to perform processing so that the toner sensor 90 detects the length of time during which toner does not exist in the slot 94. Thus, according to whether the light is blocked and the time length is within the range of a predetermined setting time T1, it exceeds T1 and is within the range of a predetermined setting time T2, or it exceeds T2, the amount of remaining toner is determined to be in a full, low, or empty state, respectively. Shortly after the low or empty state occurs because the time length exceeds T1 or T2, a problem encountered is that the amount of remaining toner is determined alternately between the low and full states, such as from the low to the full state and from the full to the low state because the value of the time length is on the borderline. To avoid this problem, a desirable method is to prevent transition to a state indicating more remaining toner after the low or empty state occurs, without a release, or over-ride, of the determined low or empty state. The release may be performed manually by the user or automatically upon the occurrence of other conditions or inputs, for example.

In this case, however, a problem occurs when toner fluidity is reduced after the toner has been stored for a long time or shortly after the toner cartridge 30 is replaced. In such a case, since, after the toner within the slot 94 is wiped off by the sensor wiper 92A, toner cannot return immediately to the slot 94, and more time elapses before the slot 94 is refilled. As a result, a detection time length described above becomes long and an incorrect detection may be made.

That is, a problem exists in that the low display appears where the full display must be turned on, or the empty display appears where the low display must be turned on. Therefore, when toner fluidity is bad in the initial stage of stirring, the amount of remaining toner cannot be correctly displayed. For example, the low display appears though a sufficient amount of toner remains, or the empty display appears though a certain amount of toner remains.

Figure 5:
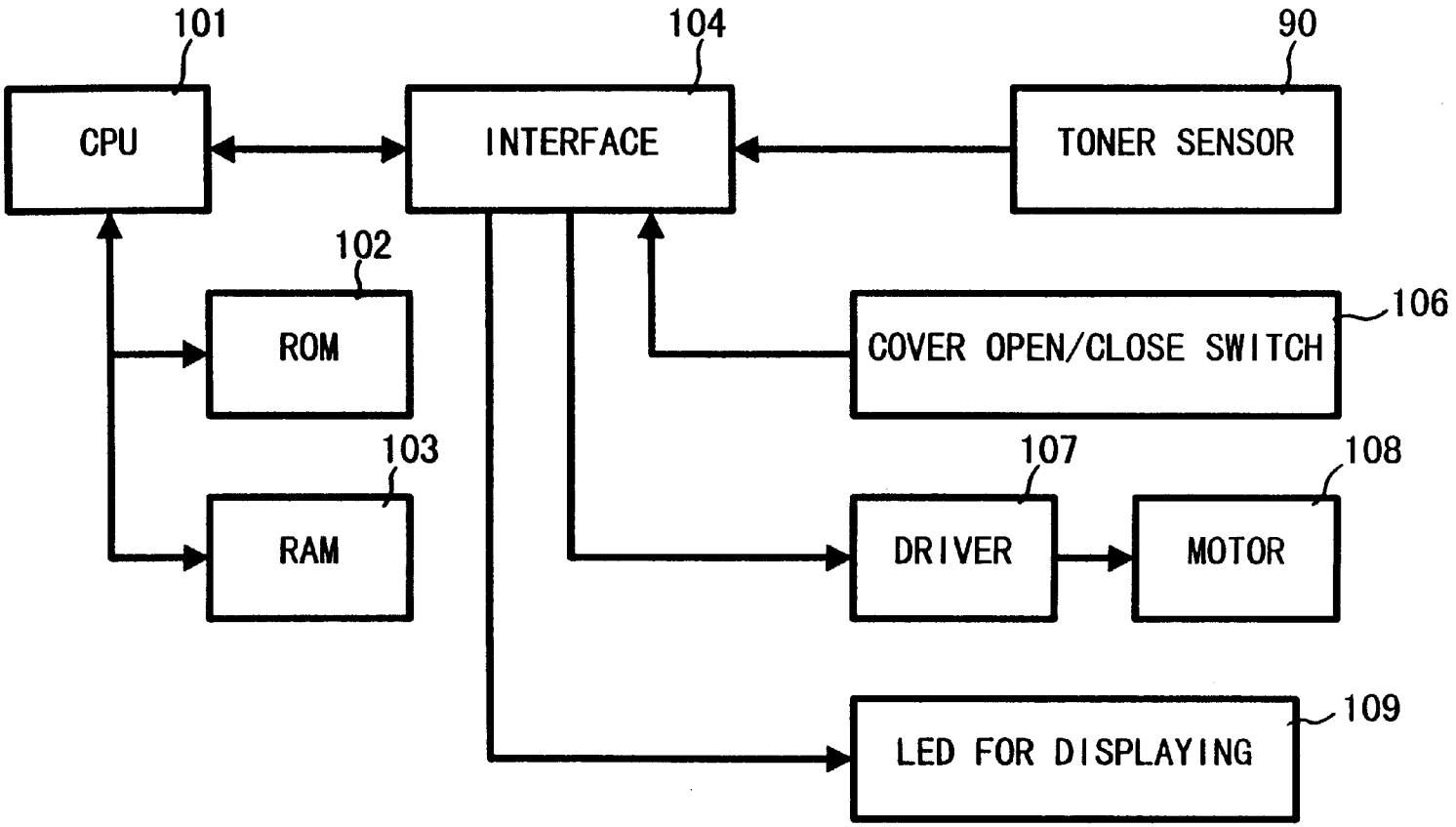
FIG. 5 is a block diagram of a toner cartridge.

This embodiment solves such a problem through the process described below. FIG. 5 is a block diagram of a toner remaining detection unit according to this embodiment. In FIG. 5, CPU 101 performs the remaining toner state determination and display control. ROM 102, for storing programs and fixed data, and RAM 103, for storing work data, are both connected to CPU 101. CPU 101 inputs and outputs data to and from other sections through an interface 104. Signals indicating the detection level of toner sensor 90 and the open/close state of cover open/close switch 106 are input to the interface 104, and to the CPU 101 as binary data. The interface 104 outputs drive signals to a driver 107 to drive a motor 108 for running the photoconductive drum 25 and the like, and control signals for controlling LED 109 and the CPU 101.

Figure 6:
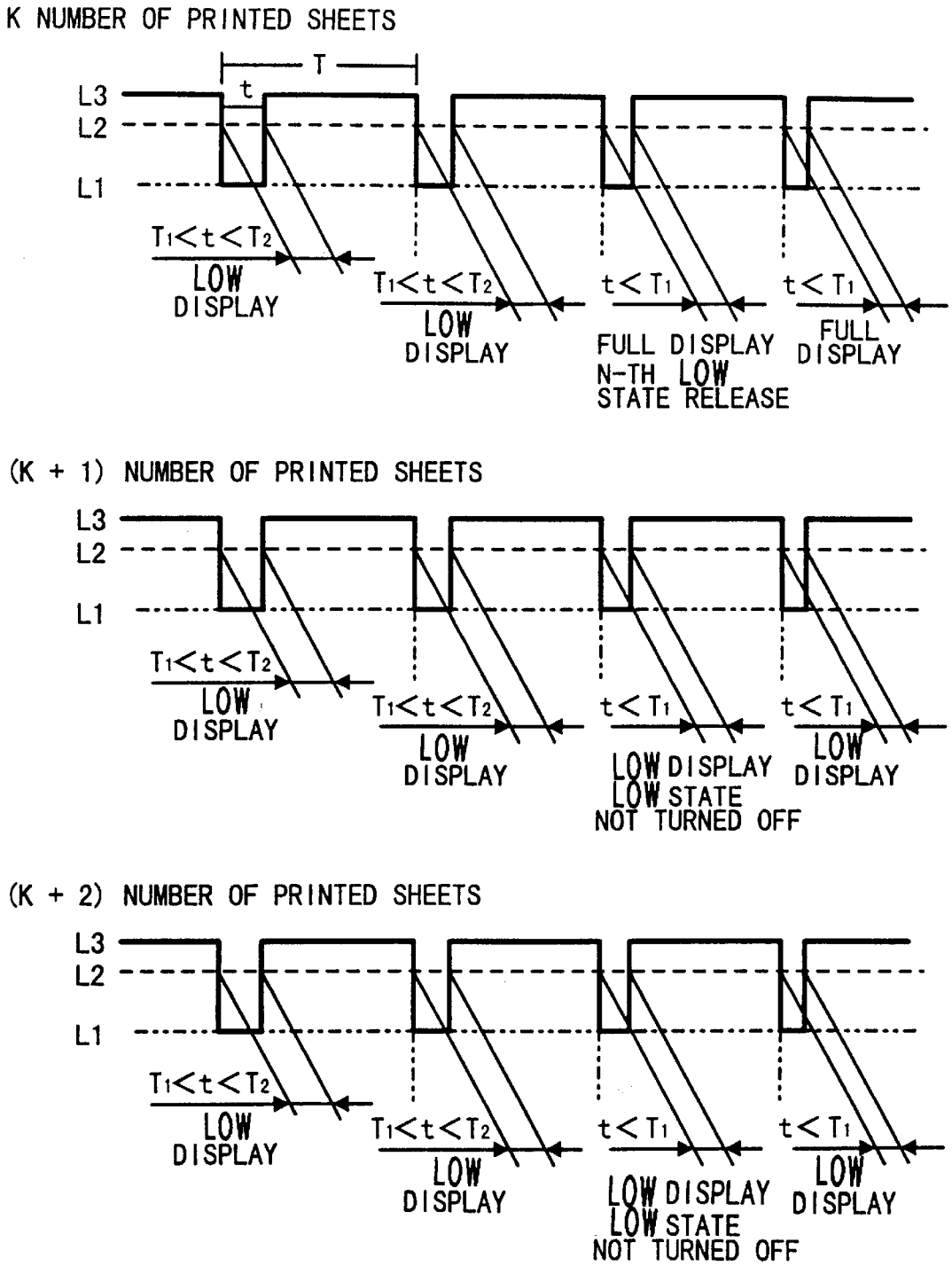
FIG. 6 is a view showing time-based change of toner sensor output.

The following describes the toner remaining determination and display control performed by CPU 101 in FIG. 5 with reference to FIG. 6. FIG. 6 shows time-based changes of the output of the toner sensor 90 during printing in this embodiment. In FIG. 6, L1 is the output of the toner sensor 90 when no toner exists in the slot 94, and L3 is the output of the toner sensor 90 when the slot 94 is filled with toner. L2 is a threshold value for evaluating toner sensor output; if a toner sensor output value is smaller than L2, the toner is determined to be empty, and if a toner sensor output value is greater than L2, the toner is determined to exist. The letter T represents the rotation cycle of the stirrer 92 and the sensor wiper 92A, which is about 0.7 seconds in this embodiment. Toner within the slot 94 is swept once during each cycle. The letter t represents the time length after the sensor wiper 92A sweeps the slot 94 at each cycle until toner is determined to be empty. The amount of remaining toner can be determined by measuring the time length t. According to whether t is smaller than a setting time T1, is in the range from T1 to T2, or it exceeds T2, the amount of remaining toner is determined to be in a full, low, or empty state, respectively. To perform the display control described above, control is performed in such a way that the number of transitions from the low to the full state are counted, until the count value reaches a predetermined number. On the other hand, when the count value exceeds the predetermined number, even if the result of determining the amount of remaining toner changes from the low to the full state, the low display remains without being turned off.

In FIG. 6, the count value is set to N times. When K number of sheets are being printed, if a count value is (N−1) times, initially the amount of remaining toner is determined to be in a low state, but at the third cycle in FIG. 6, the amount of remaining toner is determined to be in a full state, and the count value becomes N. Accordingly, at this time, the low display remains off and the full display is turned on. On the other hand, when (K+1) number of sheets are being printed, although the amount of remaining toner is determined to change from a low to a full state at the seventh cycle, the low display remains without being turned off unless the count value is reset.

In other words, as shown at the top of FIG. 6, if a low state is detected, the display will switch back to full if the toner covers the slot 94 as long as the count value N has not been reached. However, as shown in the center of FIG. 6, when the count value N is reached and the next sheet is printed, if the low state is again detected, the display will remain on the low indication even if the toner eventually covers the slot 94.

The count value is reset at power on or at toner replacement, for example. In this embodiment, N is set to 15, for example. This value suffices to avoid problems when the initial toner fluidity is bad, such as when a toner cartridge having been stored for a long time is used.

Figure 7:
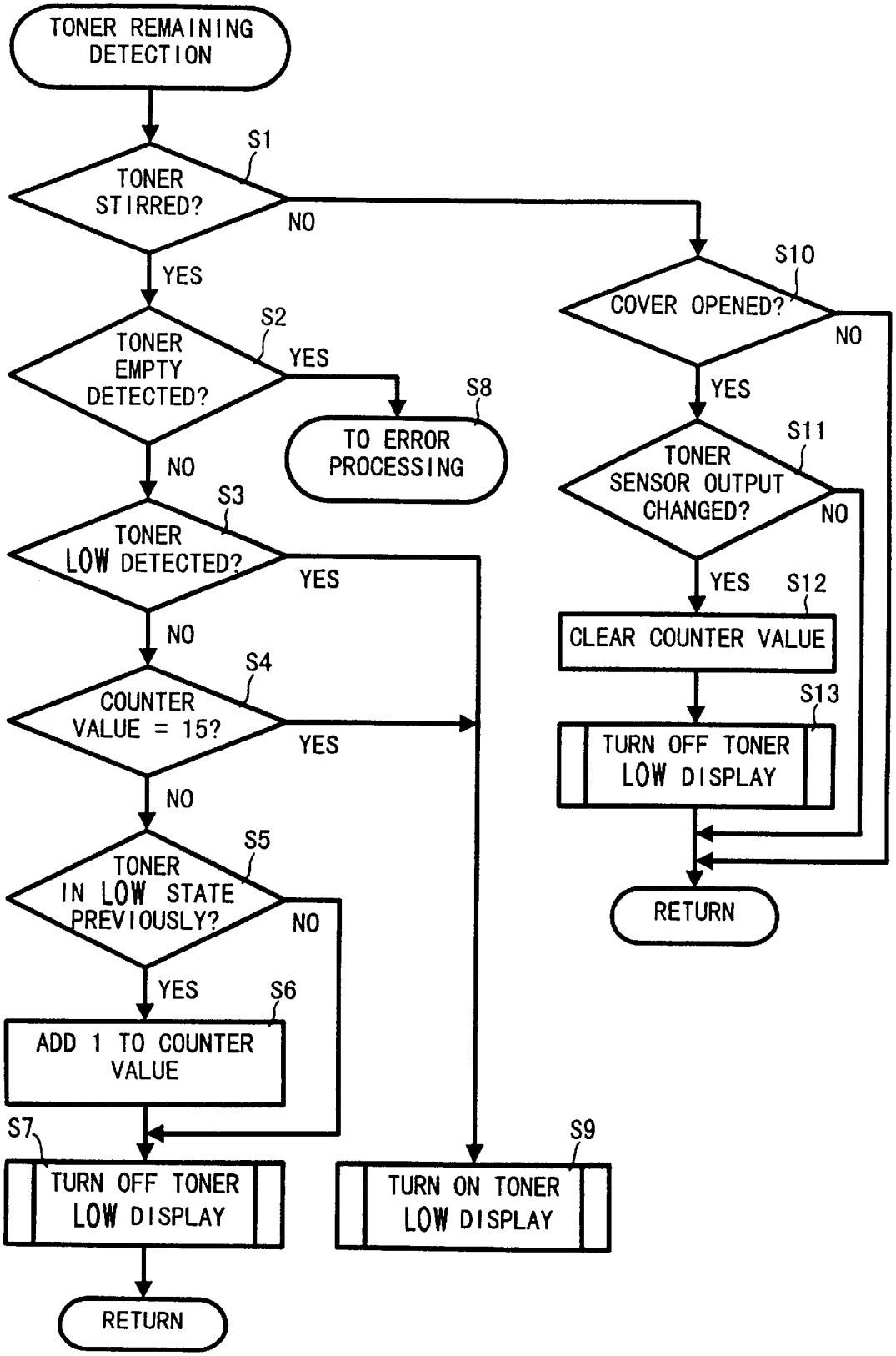
FIG. 7 is a flowchart showing toner remaining detection processing.

The following describes detailed operation of this embodiment based on the flowchart in FIG. 7. This flowchart relates to execution of a subroutine called every about 60 ms or so, by the interval timer.

The step S1 determines whether the stirrer 92 of the toner cartridge is in the process of stirring (step 1). The stirring operation can be determined because CPU 101 itself controls the driver 107 of the motor 108 in FIG. 5. If the stirring operation is not being performed, processing described below is performed.

The step S10 determines whether the cover is opened or closed. The determination can be made from the state of the cover open/close switch 106 in FIG. 5. If the cover is closed, the process is terminated, while if the cover is opened, it is determined whether the toner cartridge has been replaced. That is, with a detection signal of the toner sensor 90 monitored in the step S11, if there is no output change, the process is terminated; whereas, if there is temporary output change, the next process is performed after the determination that the toner cartridge 30 has been replaced. In other words, when the toner cartridge 30 is replaced, since the process unit 7 is first removed with the cover opened, the toner sensor goes into the state in which the light receiving section detects light. Subsequently, when the process unit 7 with a new toner cartridge 30 mounted is set in the apparatus, the light receiving section detects no light. Accordingly, replacement of the toner cartridge 30 can be detected by monitoring a detection signal of the toner sensor 90.

The step S12 clears to zero a counter value indicating the number of times the amount of remaining toner is determined to have changed from a low to a full state. This permits the release of the low state at the time of bad toner fluidity shortly after replacement of the toner cartridge 30. This process contributes to the prevention of an incorrect determination of the low state.

Clearing of the counter value is also performed at the stage of initial settings shortly after power on, though not shown in FIG. 7. The step S13 turns off the low state display in the display LED 109.

The step S1 performs the following processing if stirring is in progress. The step S2 determines whether an empty state is detected. This determination can be made by whether light passage time detected by the toner sensor 90 exceeds a setting value T2 when the inside of the slot 94 is swept by the wiper 92A (step S8). If an empty state is detected, error processing is performed (step S8).

If an empty state is not detected, the step S3 determines whether a low state is detected. It can be detected by whether the light passage time detected by the toner sensor 90 is in the range from setting values from T1 to T2 .

If a low state is not detected, the step S4 reads a counter value indicating the number of times the amount of remaining toner is determined to have changed from the low to the full state, and determines whether it has reached 15, for example. If 15 has been reached, the step S9 turns off the low state display on the LED 109, and terminates the process.

If 15 has not been reached, step S5 determines whether the amount of remaining toner was at the low state when examined previously. If so, the step S6 adds 1 to a counter value indicating the number of times the amount of remaining toner is determined to have changed from the low to the fall state. If the amount of remaining toner was not at the low state, 1 is not added to the counter value. The step S7 turns off the low display on the LED 109, and terminates the process.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A toner remaining detection unit in an image forming apparatus, comprising:

a toner cartridge containing toner that is supplied to a developing chamber;

a toner amount detector that detects an amount of toner remaining within the toner cartridge;

a toner state determination unit that determines a state of the toner in the toner cartridge based on the amount of toner remaining as detected by the toner amount detector, wherein the toner states include full, low, and empty states;

a display controller that determines display contents based on the toner state determined by the toner state determination unit; and a display that indicates the display contents determined by the display controller;

wherein the toner state determination unit includes a counter that counts a number of toner state changes from the low state to the full state so that after a predetermined number of changes occurs, the display controller prevents the display from switching from a low state to a full state indication.

2. The toner remaining detection unit of claim 1, wherein the toner cartridge is detachable from the image forming apparatus.

3. The toner remaining detection unit of claim 2, wherein the counter is initialized after replacement of the toner cartridge and a low state occurs.

4. The toner remaining detection unit of claim 1, wherein the toner cartridge further comprises a depression being formed at a lower portion thereof and a slot formed in the depression that stores toner.

5. The toner remaining detection unit of claim 4, wherein the toner amount detector further comprises a wiper that periodically sweeps the slot.

6. The toner remaining detection unit of claim 5, wherein the toner amount detector further comprises a toner existence detector that detects whether toner exists within the slot.

7. The toner remaining detection unit of claim 6, wherein the toner existence detector is a toner sensor having a light source section and a light receiving section.

8. The toner remaining detection unit of claim 7, wherein an optical axis exists between the light source section and the light receiving section, the optical axis being positioned so as to pass through the slot.

9. The toner remaining detection unit of claim 8, wherein the toner amount detector further comprises a light passage time unit that determines an amount of toner remaining in the toner cartridge based on a time-based change of existence of toner within the slot.

10. The toner remaining detection unit of claim 9, wherein the toner amount detector determines whether a sufficient amount of toner exists in the toner cartridge after the wiper sweeps the slot.

11. The toner remaining detection unit of claim 10, wherein the toner amount detector determines the three toner states based on the length of time during which toner does not exist in the slot.

12. The toner remaining detection unit of claim 11, wherein the toner amount detector determines the three toner states according to whether the light source receiving section can detect light from the light source and a time length is determined to be within a predetermined setting time T1, exceeds T1 and is within the range of a predetermined setting time T2, or exceeds T2, the toner state is determined to be in a full, low, or empty state, respectively.

13. The toner remaining detection unit of claim 12, wherein the wiper is part of the stirrer and is subjected to rotational control to stir the toner.

14. The toner remaining detection unit of claim 5, wherein the toner cartridge further comprises a stirrer that stirs the toner.

15. The toner remaining detection unit of claim 6, wherein the toner existence detector is placed in a lower portion of the toner cartridge.

16. A storage medium for storing programs for detecting toner remaining in a toner cartridge used in an image forming apparatus, the program comprising:

a program for detecting an amount of toner remaining within the toner cartridge;

a program for determining the state of the toner in the toner cartridge based on the amount of toner remaining, wherein the toner states include full, low, and empty states;

a program to control and determine display contents based on the determined state of toner in the toner cartridge; and a program to count a number of changes in the state of the toner cartridge from the low state to the full state so that after a predetermined number of changes occurs, a display is prevented from switching from a low state to a full state indication.

17. The storage medium of claim 16, further comprising:

a program to initialize a counter either after the image forming apparatus is powered on and a low state occurs, or after replacement of the toner cartridge and a low state occurs.

18. The storage medium of claim 17, further comprising:

a program to detect whether toner exists in a slot formed in a lower portion of the toner cartridge.

19. The storage medium of claim 18, further comprising:

a program for determining the amount of toner remaining in the toner cartridge based on a time-based change of existence of toner within the slot.

20. The storage medium of claim 19, further comprising:

a program for determining the amount of toner remaining in the toner cartridge based on inputs from a toner sensor located in the toner cartridge that senses whether toner is present based on a light directed from a light source section to a light receiving section.

* * * * *